US010213913B2

(12) United States Patent
Pang

(10) Patent No.: US 10,213,913 B2
(45) Date of Patent: Feb. 26, 2019

(54) TOOL STORAGE ASSEMBLY

(71) Applicant: Andy Ka Keung Pang, Burnaby (CA)

(72) Inventor: Andy Ka Keung Pang, Burnaby (CA)

(73) Assignee: Andy Ka Keung Pang, Burnaby (CA)

( * ) Notice: Subject to any disclaimer, the term of this patent is extended or adjusted under 35 U.S.C. 154(b) by 373 days.

(21) Appl. No.: 15/198,074

(22) Filed: Jun. 30, 2016

(65) Prior Publication Data

US 2018/0001468 A1 Jan. 4, 2018

(51) Int. Cl.

| | |
|---|---|
| ***B25H 3/00*** | (2006.01) |
| ***B25H 3/06*** | (2006.01) |
| ***B65D 25/10*** | (2006.01) |

(52) U.S. Cl.

CPC ..... *B25H 3/003* (2013.01); *B25H 3/06* (2013.01); *B65D 25/106* (2013.01)

(58) Field of Classification Search

CPC ..... B65D 81/1075; B25H 3/00; B25H 3/003; B25H 3/006; B25H 3/04; B25H 3/06

USPC ..... 206/591, 592; 220/23.4

See application file for complete search history.

(56) References Cited

U.S. PATENT DOCUMENTS

| | | | | |
|---|---|---|---|---|
| 2,282,908 | A | 5/1942 | Thompson | |
| 2,928,100 | A | 3/1960 | Gagnon | |
| 3,285,768 | A | 11/1966 | Habib | |
| 3,723,061 | A | 3/1973 | Stahl | |
| 3,880,285 | A | 4/1975 | March | |
| 3,927,767 | A | 12/1975 | Sato et al. | |
| 4,093,010 | A | 6/1978 | Hunley et al. | |
| 4,485,919 | A | 12/1984 | Sandel | |
| 4,658,567 | A | 4/1987 | Arada | |
| 4,836,374 | A | 6/1989 | Hutchins et al. | |
| 5,154,544 | A | 10/1992 | Arendt | |
| 5,409,560 | A | 4/1995 | Hammer et al. | |
| 5,511,662 | A | 4/1996 | Amoroso et al. | |
| 5,772,038 | A * | 6/1998 | Murata | H01L 21/67333 206/564 |
| 6,843,458 | B1 * | 1/2005 | Robinson | A47G 23/0216 248/311.2 |

(Continued)

FOREIGN PATENT DOCUMENTS

| | | |
|---|---|---|
| DE | 2907253 | 9/1980 |
| EP | 2279832 A2 | 2/2011 |
| FR | 1341968 | 9/1963 |

OTHER PUBLICATIONS

WayBackMachine archived web printout of "http://web.archive.org/web/20140108030512/http://www.bunnings.com.au/sidchrome-7-drawer-tool-trolley_p6120152", Bunnings Warehouse, dated Jan. 8, 2014.

(Continued)

*Primary Examiner* — Steven A. Reynolds
*Assistant Examiner* — Javier A Pagan
(74) *Attorney, Agent, or Firm* — Cameron IP

(57) ABSTRACT

There is provided a tool storage assembly. The assembly includes a plurality of modular bases. The bases are selectively connectable together at peripheral side portions thereof. The assembly includes a plurality of retaining members coupled to the bases. The assembly includes a plurality of actuators each associated with a respective ones of the retaining members. Selective actuation of selective ones of the actuators releases corresponding selective ones of the retaining members. Remaining ones of the retaining members form a plurality of customized storage receptacles thereafter.

20 Claims, 18 Drawing Sheets

(56) References Cited

U.S. PATENT DOCUMENTS

| | | | | |
|---|---|---|---|---|
| 8,104,615 | B2 | 1/2012 | Liu | |
| 9,358,930 | B1 * | 6/2016 | Sic | B60N 3/101 |
| 2005/0011788 | A1 | 1/2005 | Hsien | |
| 2005/0017003 | A1 | 1/2005 | Sullivan et al. | |
| 2006/0091031 | A1 | 5/2006 | Bowen et al. | |
| 2007/0144986 | A1 | 6/2007 | Hill | |
| 2010/0090383 | A1 * | 4/2010 | Rawls-Meehan | A47C 7/027<br>267/145 |
| 2010/0155347 | A1 * | 6/2010 | McConnell | A47F 5/0018<br>211/85.8 |

OTHER PUBLICATIONS

WayBackMachine archived web printout of "http://web.archive.org/web/20130701000000*/http://www.lista-government.com/images/picture/tool-rooms/hand-tool-storage-2.jpg", dated Dec. 24, 2013.
WayBackMachine archived web printout of "http://web.archive.org/web/20150711132854/http://www.drapertools.com/product/13532/Expert-110-Piece-1-4-3-8inch-Sq.-Dr.-Metric-Socket-and-Bit-Set-in-EVA-Foam-Insert-Tray", Draper Tools, Inc., dated Jul. 11, 2015.
WayBackMachine archived web printout of "http://web.archive.org/web/20141214053358/http://www.thepelicanstore.com/Pick-N-Pluck-Foam.aspx", Pelican Pick-N-Pluck Foam, dated Dec. 14, 2014.
English Abstract of DE2907253.

* cited by examiner

TOOL STORAGE ASSEMBLY

BACKGROUND OF THE INVENTION

Field of the Invention

There is provided a storage assembly. In particular, there is provided a tool storage assembly.

Description of the Related Art

U.S. Pat. No. 4,485,919 to Sandel discloses a sterilizable support tray for medical instruments. The support tray includes a block of sterilizable reticulated foam material having multiple parallel longitudinally-extending and laterally-extending slices which penetrate partially through the thickness of the foam block. In addition to a vertical component, at least one of the slices includes a horizontal component for defining a plane and creating a reduced cross-section partable web attaching multiple finger portions created by said slices to an unsliced base portion. The partable webs define a location and plane at which individual finger portions may be torn away from the base portion to define custom-shaped channels within which medical instruments may be positioned, stored, sterilized, and accounted for.

German Patent Reference No. 2,907,253 A1 to Kracht discloses a synthetic foam package. The foam package is block-shaped, and has a recess of the dimensions of shape of the object, which is to be protected against impact or shaking. Gross-cuts, especially perforation cuts, are evenly distributed over the surface of the block and extend over its complete height. The cuts are parallel and extend across each other at right angles, but may be at an acute angle of preferably 45 degrees to the sides of the block. One or more webs may be located between the cuts and crossing points.

U.S. Pat. No. 5,409,560 to Hammer et al. discloses a method of making liners for tool boxes. The method provides custom formed liners to fit a specific selection and arrangement of tools in a tool chest, box or drawer. The method comprises first cutting a backing sheet and a tool receptacle sheet to fit the selected tool drawer or container, and laminating the receptacle sheet to the underlying backing sheet. The selected tools are then laid out on top of the receptacle sheet according to the pattern desired and their outlines traced on the top of the receptacle sheet. The tool receptacles are then cut through the receptacle sheet, down to but not through the underlying backing sheet, along the traced lines. A liquid plastic or vinyl material may be added to the bottoms of the completed receptacles if desired, and allowed to cure to further cushion any tools placed therein. The liquid plastic material may be provided in different colors to assist in the proper placement of tools and in the determination of missing tools. The backing sheet is preferably somewhat stiffer and firmer than the receptacle sheet, and may be formed of wood, plastic, rubber, or metal, as desired. The receptacle sheet may be formed of any suitable resilient material; preferably a closed cell foam material is used. The receptacles may be die cut for production purposes if desired.

BRIEF SUMMARY OF INVENTION

There is provided, and it is an object to provide, an improved tool storage assembly.

There is accordingly provided a tool storage assembly. The assembly includes a planar base. The assembly includes a plurality of retaining members coupled to the base. The assembly includes at least one actuator, actuation of which releases at least one of the retaining members from the base. Remaining ones of the retaining members and the planar base form a storage receptacle thereafter.

There is also provided a tool storage assembly. The assembly includes a plurality of modular bases. The bases are selectively connectable together at peripheral side portions thereof. The assembly includes a plurality of retaining members coupled to the bases. The assembly includes a plurality of actuators each associated with a respective ones of the retaining members. Selective actuation of selective ones of the actuators releases corresponding selective ones of the retaining members. Remaining ones of the retaining members form a plurality of customized storage receptacles thereafter.

There is further provided a block assembly. The assembly includes a planar base. The assembly includes a plurality of block members coupled to the base. The assembly includes a plurality of actuators each associated with a respective ones of the block members. Selective actuation of selective ones of the actuators releases corresponding selective ones of the block members. Remaining ones of the block members enclose a customized shape.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
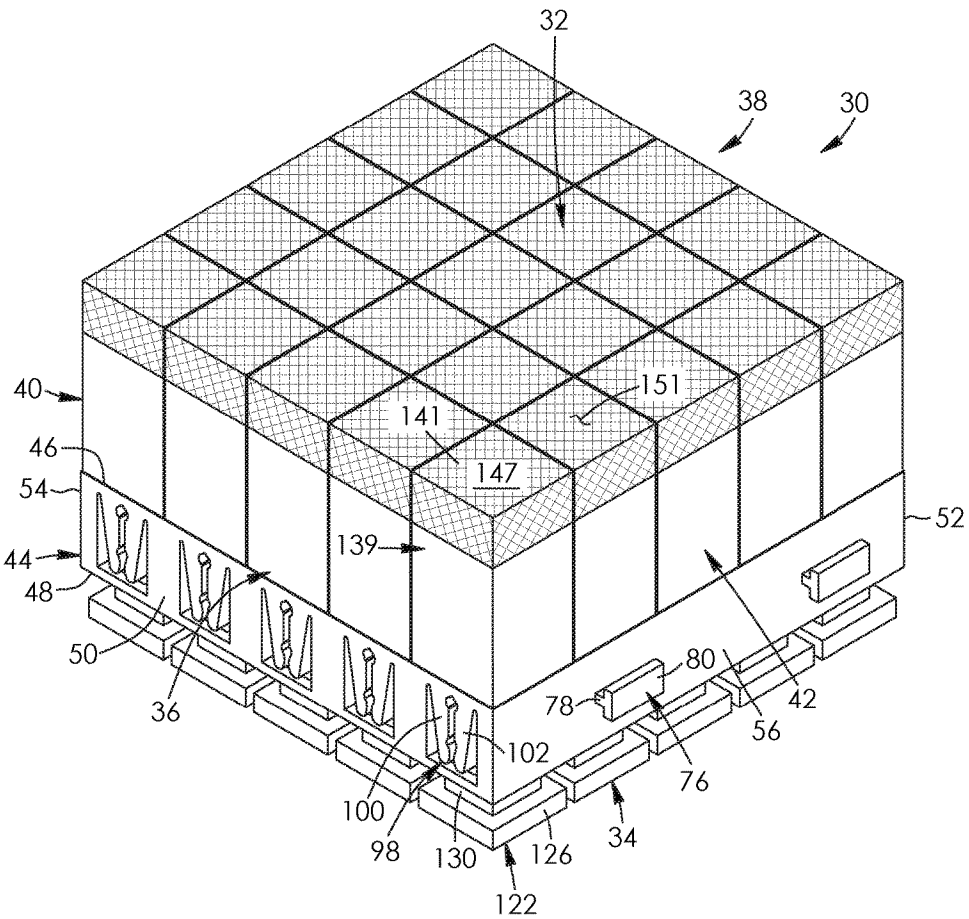
FIG. 1 is a top, front, right side isometric view of a tool storage assembly according to one aspect, the assembly including a grid member and a plurality of retaining members and actuators shown inserted within the grid member.

Referring to the drawings and first to FIG. 1, there is shown a tool storage assembly 30. The assembly may be referred to in this example as a block assembly.

The assembly 30 has a top 32, a bottom 34 opposite the top, a front 36, a rear 38 spaced-apart from the front, and a pair of spaced-apart sides 40 and 42. The front, rear and sides of the assembly extend between the top 32 and bottom 34 of the assembly. The front 36 and rear 38 of the assembly 30 extend between the sides 40 and 42 of the assembly. The assembly 30 is a generally rectangular prism in shape in this example, with the front 36, rear 38 and sides 40 and 42 being generally rectangular in shape, and the top 32 and bottom 34 being generally square in shape. However, the top and bottom may be other shapes in other embodiments.

Figure 2:
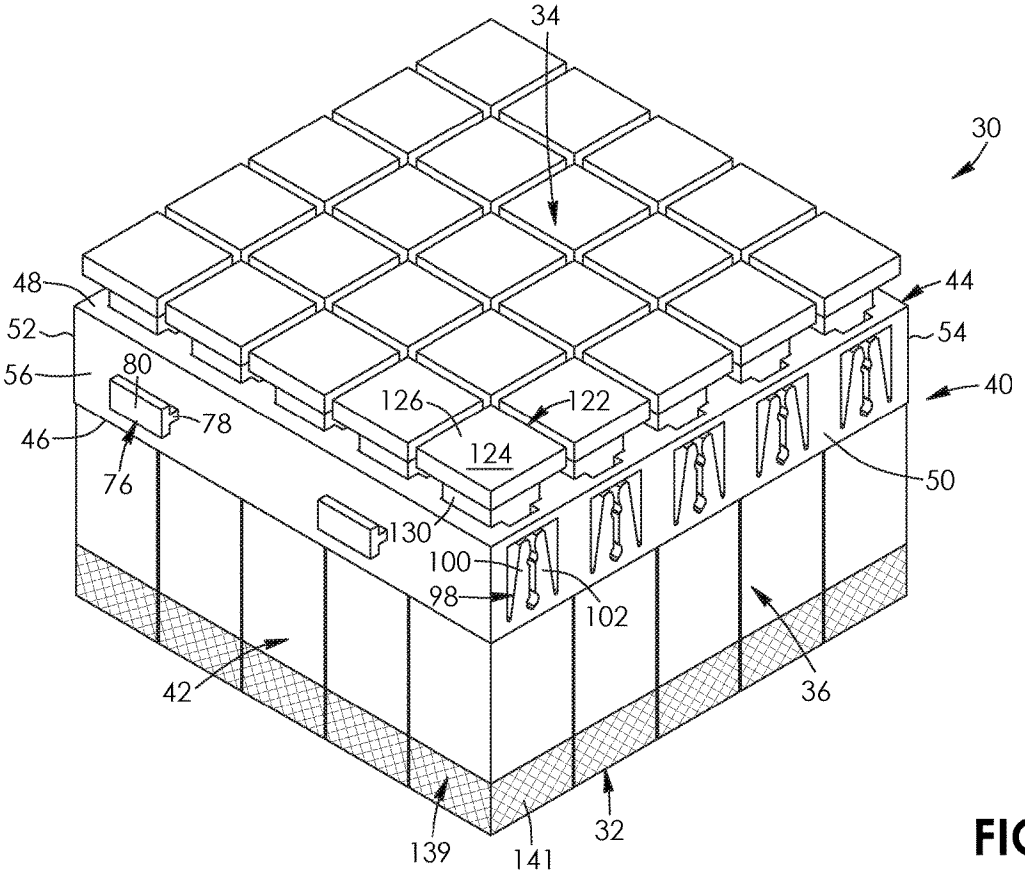
FIG. 2 is a bottom, front, right side isometric view of the tool storage assembly of FIG. 1.
Figure 3:
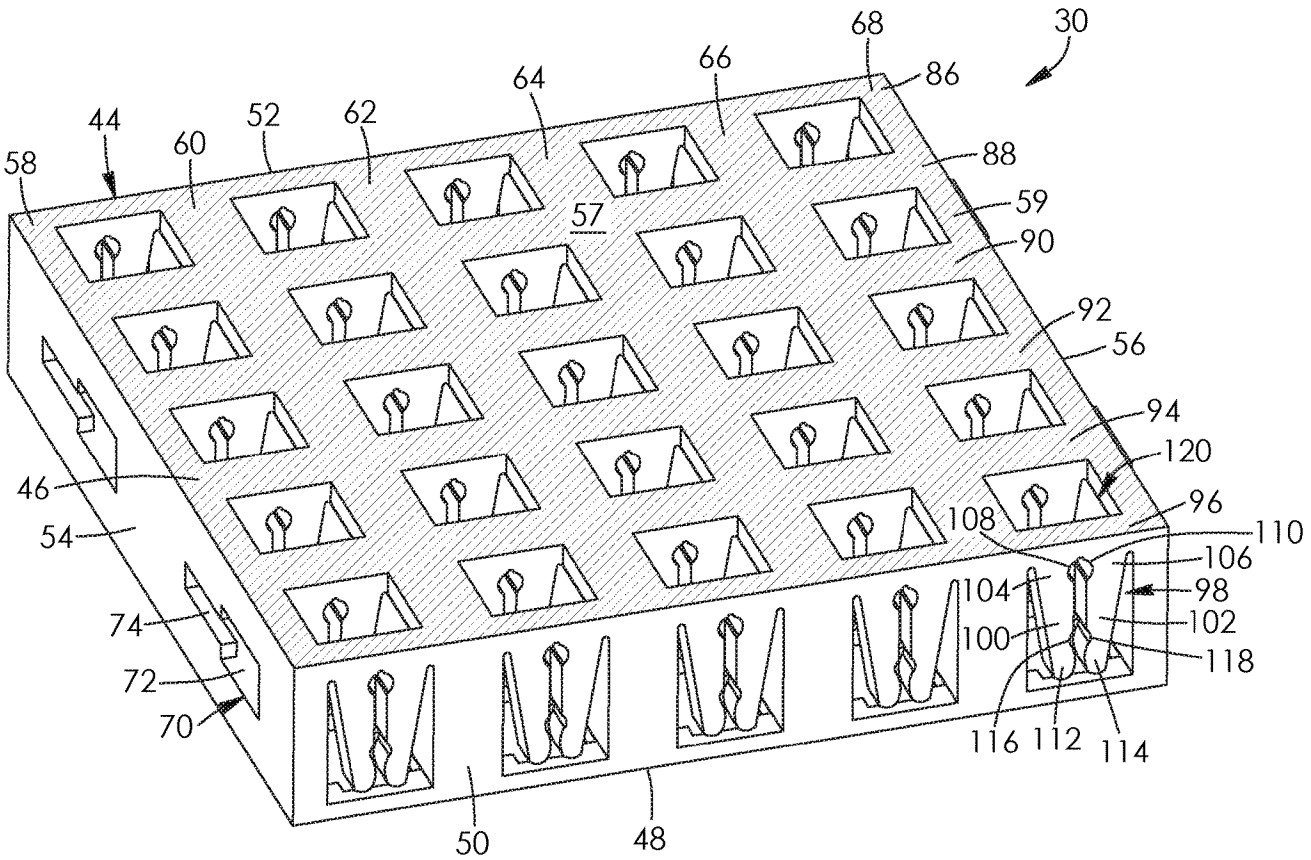
FIG. 3 is a top, front, left side isometric view of the grid member of FIG. 1, with the retaining members and actuators of the assembly being removed.
Figure 4:
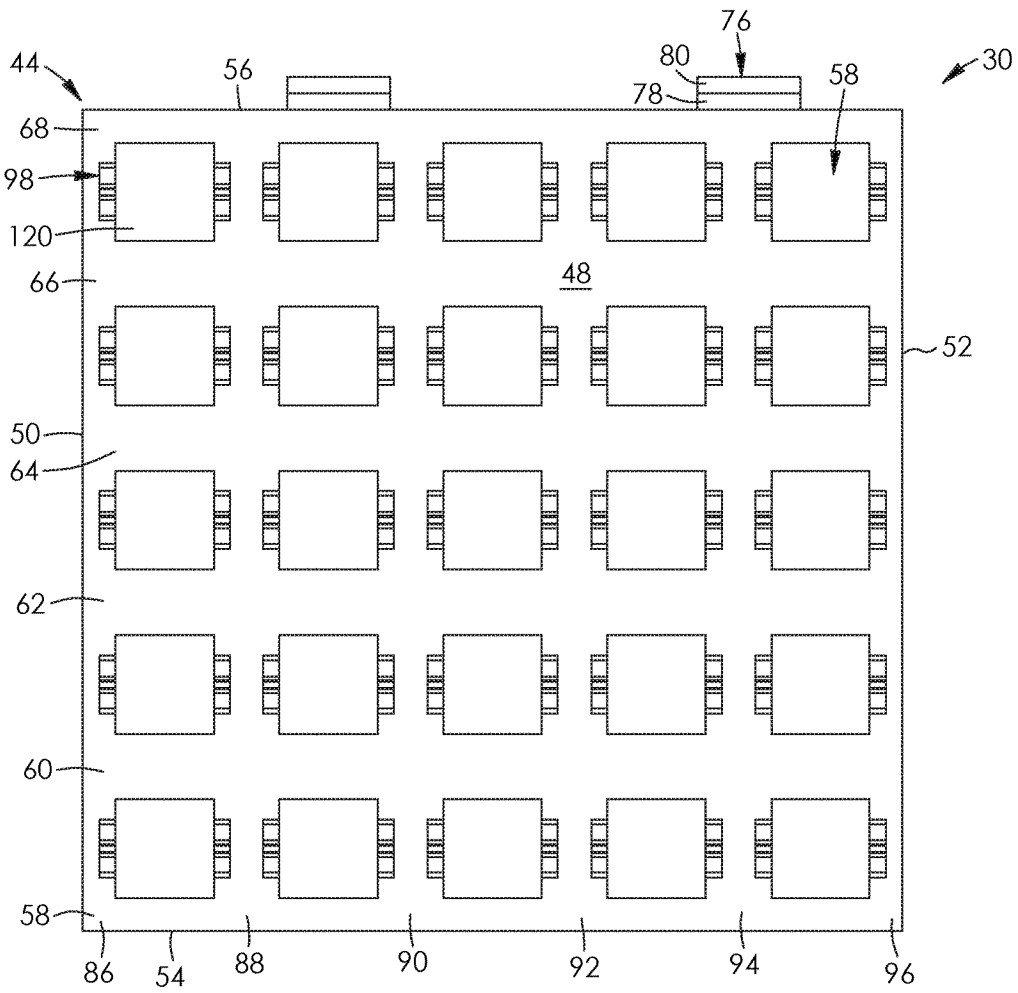
FIG. 4 is a bottom plan view of the grid member of FIG. 3.

As best seen in FIGS. 3 and 4, the assembly includes a planar base, in this example a grid member 44. The grid member has a top 46, a bottom 48 opposite the top, a front 50, a rear 52 spaced-apart from the front, and a pair of spaced-apart sides 54 and 56. The front, rear and sides of the grid member 44 extend between the top 46 and bottom 48 of the grid member. The front 50, rear 52 and sides 54 and 56 of the grid member 44 are generally rectangular in shape in this example, and the top 46 and bottom 48 are of the grid member are generally square in shape. However, the top and bottom may be other shapes in other embodiments. The front 50 and rear 52 of the grid member extend between the sides 54 and 56 of the grid member. As seen in FIG. 1, the front 50 of the grid member 44 aligns with the front 36 of the assembly 30 and side 56 of the grid member 44 aligns with the side 42 of the assembly. As seen in FIG. 2, the rear 52 of the grid member aligns with the rear 38 of the assembly and side 54 of the grid member aligns with side 40 of the assembly. Bottom 48 of the grid member 44 aligns with and is adjacent to the bottom 34 of the assembly 30.

As seen in FIG. 3, the top 46 of the grid member 44 of the assembly 30 has an outer surface 57 with a first indicia thereon, in this example a first color as shown by markings of numeral 59.

The grid member 44 includes a first plurality of spaced-apart elongate members, in this example elongate members 58, 60, 62, 64, 66 and 68 which extend in columns from the perspective of FIG. 3. Each of the elongate members is generally a rectangular prism in shape in this example and extends between the front 50 and rear 52 of the grid member 44. The elongate members 58, 60, 62, 64, 66 and 68 extend in parallel with each other in this example.

Elongate member 58 aligns with and extends along side 54 of the grid member. Elongate member 58 has a plurality of apertures, in this example a pair of apertures extending therethrough from side 54 of the grid member 44 towards side 56 of the grid member. This is shown by aperture of numeral 70. Each of the apertures has an enlarged region 72 which in this example is rectangular and a narrow region, in this example a slot-shaped region 74. The slot-shaped region of the aperture 70 is rectangular in shape in this example, and is in communication with and smaller than the enlarged region 72 of the aperture.

Figure 9:
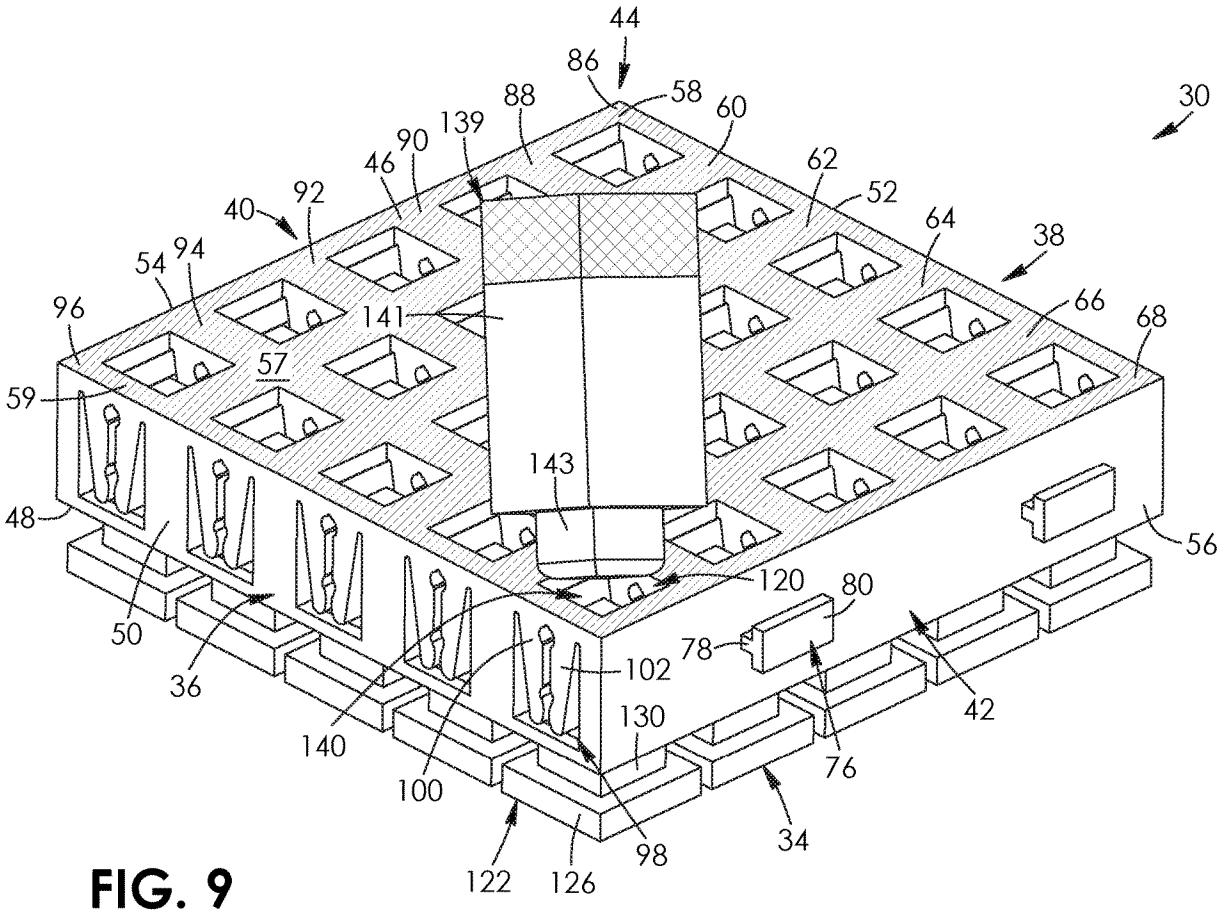
FIG. 9 is a top, front, right side isometric view of the grid member and actuators of FIG. 7, the grid member having a plurality of recessed regions, and with the retaining member of FIG. 8 being shown in the process of being inserted within one of the recessed regions of the grid member.
Figure 10:
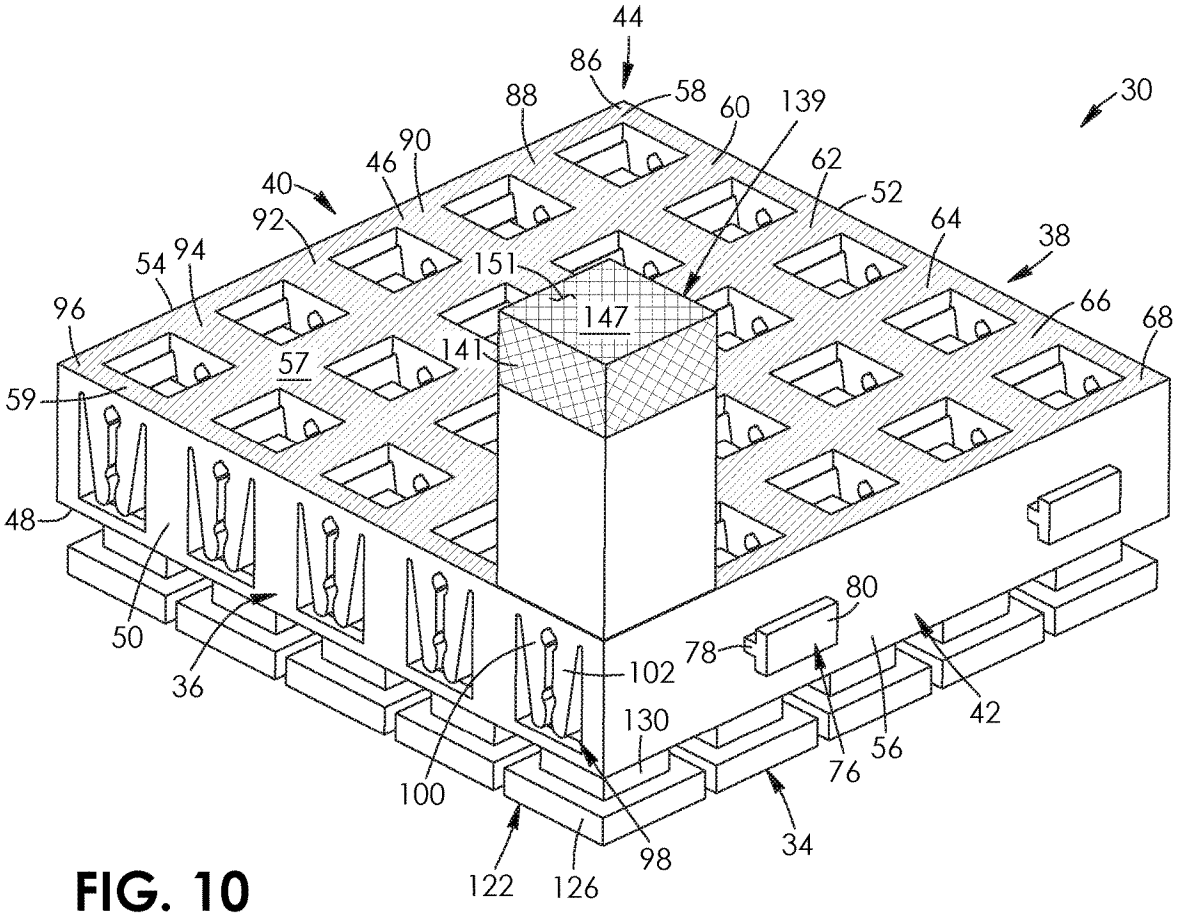
FIG. 10 is a top, front, right side isometric view of the grid member and actuators of FIG. 9, with the retaining member of FIG. 8 shown inserted within one of the recessed regions of the grid member.

As seen in FIG. 9, elongate member 68 aligns with and extends along side 56 of the grid member 44. Elongate member 68 includes a plurality of protrusions, in this example a pair of protrusions extending outwards therefrom in the direction of the side 42 of the assembly 30. This is shown by protrusion 76 which in this example includes a first horizontally-extending portion 78 and a second, vertically-extending portion 80, from the perspective of FIG. 9. The portions of the protrusion are rectangular prisms in shape in this example and each protrusion is t-shaped in lateral cross-section in this example. Portion 78 of protrusion 76 is shaped to snugly fit within slot-shaped region 74 of the aperture 70 of elongate member 58 seen in FIG. 3. Referring back to FIG. 9, portion 80 of the protrusion 76 is shaped to fit within enlarged region 72 of the aperture 70 seen in FIG. 3.

Figure 17:
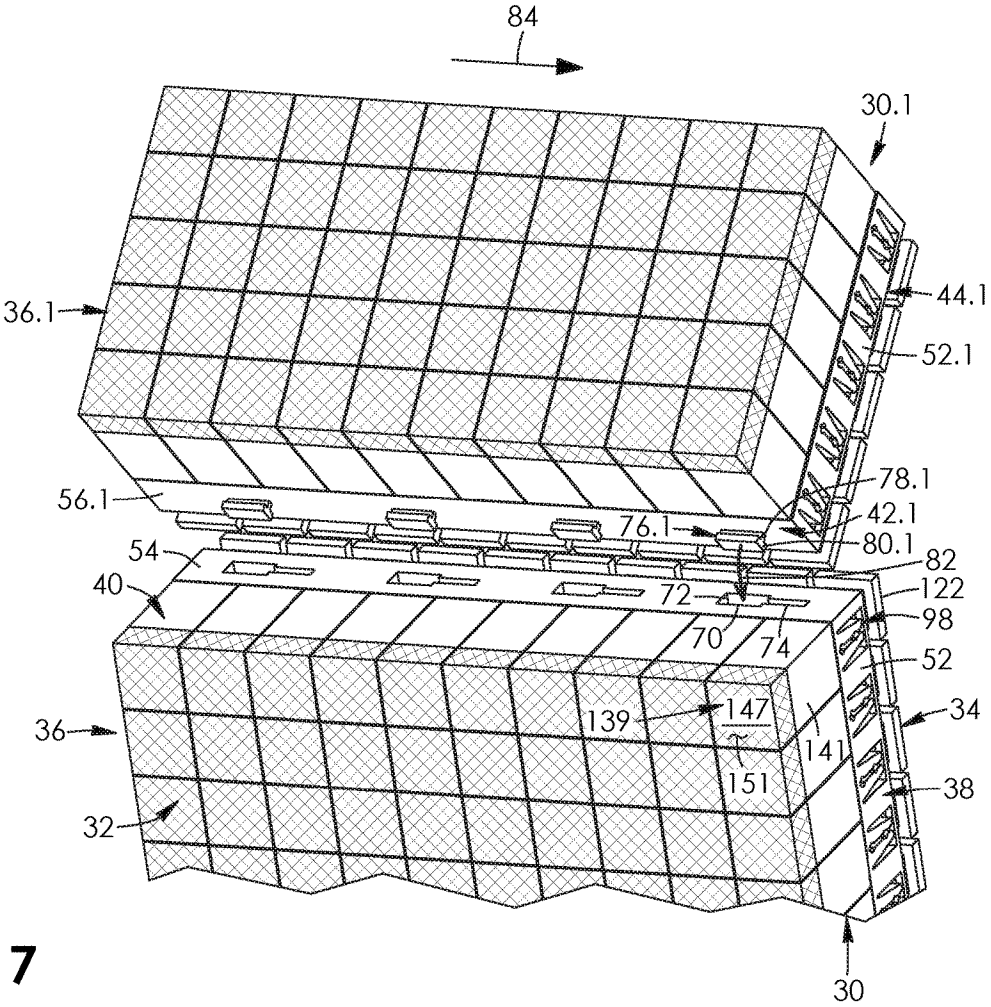
FIG. 17 is top, rear perspective view of a pair of the tool storage assemblies of FIG. 1 in the process of coupling together in a modular manner, with one of the tool storage assemblies being shown partially in fragment.

FIG. 17 shows a pair of assembly 30 and 30.1 which are substantially same in parts and functions, with like parts of assembly 30.1 having the same numbers as assembly 30 with the addition of decimal extension "0.1". As seen in FIG. 17, protrusions 76.1 of grid member 44.1 of assembly 30.1 are shaped to fit within enlarged regions 72 of apertures 70 of grid member 44 of assembly 30, as indicated by arrow of numeral 82. Thereafter, the protrusions of assembly 30.1 may be moved towards the slot-shaped regions 74 of the apertures, as shown by arrow of numeral 84. In this manner, assemblies 30 and 30.1 may selectively couple together and further assemblies may be added or removed in a modular manner as required. The grid members 44 and 44.1 may thus be said to be selectively connectable together at peripheral side portions thereof.

Referring back to FIG. 3, the grid member 44 includes a second plurality of evenly spaced-apart elongate members, in this example elongate members 86, 88, 90, 92, 94 and 96 which extend in rows from the perspective of FIG. 3. Each of the elongate members is generally a rectangular prism in shape in this example and extends between the sides 54 and 56 of the grid member 44. Elongate members 86, 88, 90, 92, 94 and 96 couple to, are integrally formed with and are arranged perpendicular to elongate members 58, 60, 62, 64, 66 and 68 in this example. The members form a unitary structure in the form of grid member 44.

Each of the second plurality of elongate members 86, 88, 90, 92, 94 and 96 includes a plurality of catch mechanisms interposed between respective ones of the first plurality of elongate members 58, 60, 62, 64, 66 and 68. This is shown by catch mechanism 98 of elongate member 96 which is interposed between elongate members 66 and 68.

As seen in FIG. 3, each catch mechanism in this example includes a pair of cantilevered elongate gripping members 100 and 102. The gripping members are resilient at least in part and are generally triangular in front profile in this example. The gripping members have proximal ends 104 and 106 coupled to their corresponding elongate member 96 adjacent to the top 46 of the grid member 44. The gripping members 100 and 102 include first or upper recessed portions 108 and 110 which are semi-circular in this example and which are adjacent to the proximal ends 104 and 106 thereof. Recessed portions 108 and 110 may be referred to inner recessed portions.

The gripping members have distal ends 112 and 114 spaced-apart from the proximal ends. The distal ends of the gripping members 100 and 102 are adjacent to the bottom 48 of the grid member 44 in this example. The gripping members 100 and 102 taper as they extend from the proximal ends 104 and 106 to their distal ends 112 and 114 in this example. The gripping members 100 and 102 include second or lower recessed portions 116 and 118 which are semi-circular in this example and which are adjacent to the distal ends thereof. Recessed portions 116 and 118 may be referred to inner recessed portions.

As seen in FIG. 3, the grid member 44 has a plurality of sockets extending therethrough, each of which being between adjacent ones of the first plurality of elongate members and between adjacent ones of the second plurality of elongate members. This is shown by socket 120 which is between elongate members 66 and 68, and between elongate members 94 and 96. Each of the sockets is generally a rectangular prism in shape and square in top and bottom profile in this example. Each of the sockets 120 extends from the top 46 of the grid member 44 through to the bottom 48 of the grid member, seen in FIG. 4, in this example.

Figure 5:
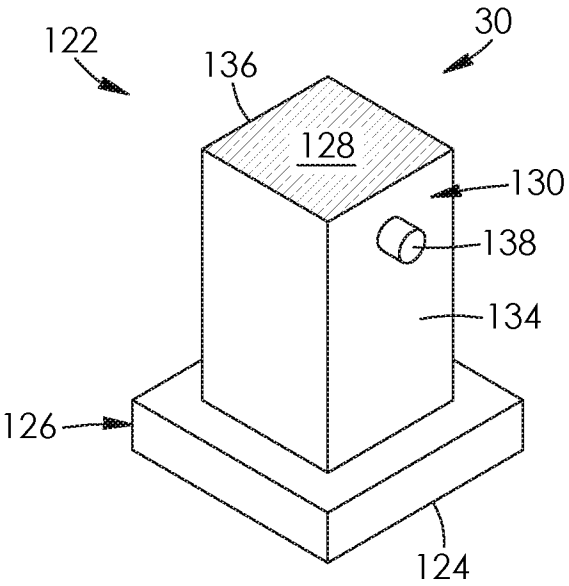
FIG. 5 is a top, front, side isometric view of one of the actuators of the assembly of FIG. 1.

As seen in FIG. 1, the tool storage assembly 30 includes a plurality of actuators, in this example push-responsive actuators as shown by push-responsive actuator 122. Referring to FIG. 5, each actuator has a bottom 124 and includes a contact portion, in this example a flange 126 aligned with the bottom. Each actuator 122 has a top 128 spaced-apart from the bottom and includes a protrusion 130 coupled to, integrally formed with and extending upwards from the flange, from the perspective of FIG. 5. The flange 126 and the protrusion of each actuator are rectangular prisms in shape in this example. The protrusion 130 is centrally positioned relative to the flange 126 and the flange extends outwards relative to the protrusion in this example. Protrusions 130 are shaped to fit within respective ones of the sockets 120 of the grid member 44 seen in FIG. 3.

Figure 6:
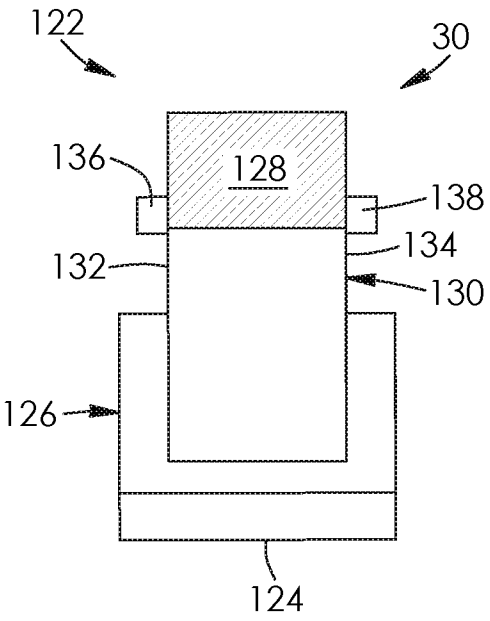
FIG. 6 is a top, front isometric view of the actuators of FIG. 5.

As seen in FIG. 6, each actuator 122 has a pair of spaced-apart sides 132 and 134 which extend between the top 128 and bottom 124 thereof. Each actuator includes a pair of protuberances 136 and 138 in this example coupled to the protrusion 130 thereof. The protuberances are cylindrical in shape in this example and couple to, are integrally formed with and extend from respective ones of the sides 132 and 134 of the actuator 122.

Figure 11:
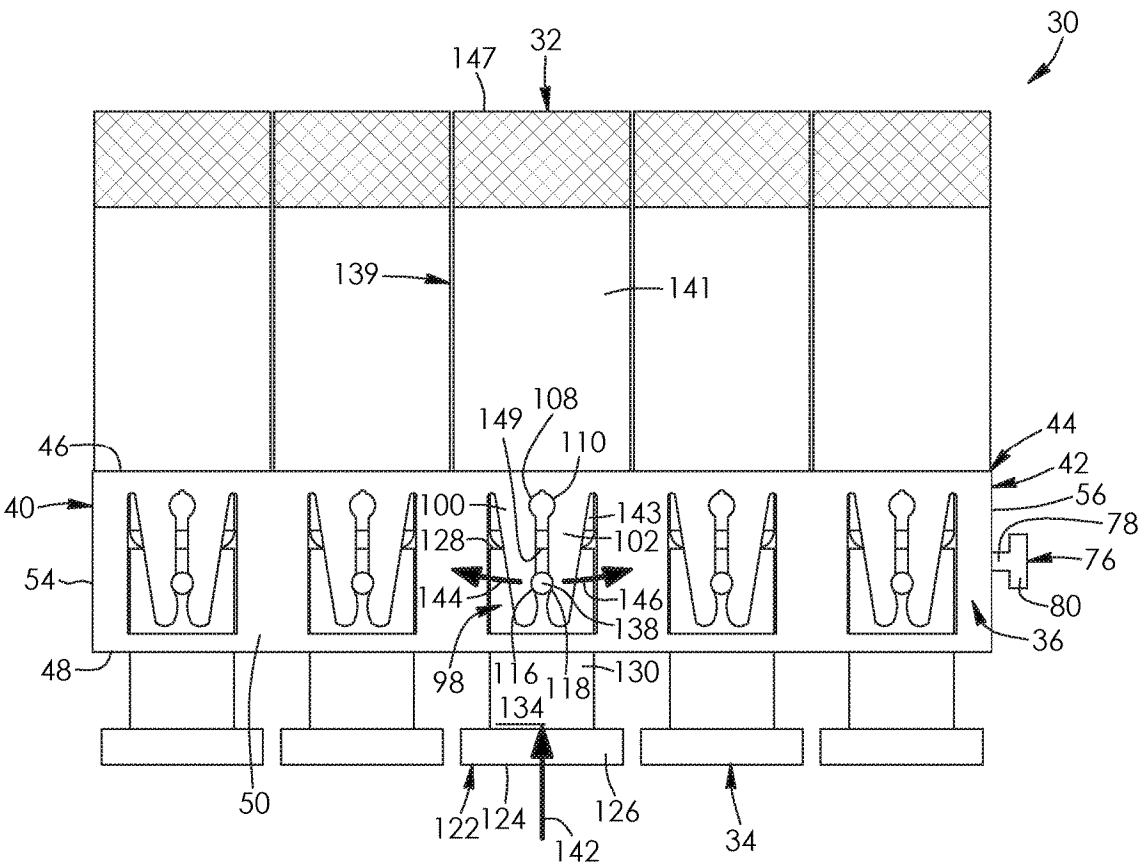
FIG. 11 is a front elevation view of the assembly of FIG. 1, with the actuators being shown in retracted positions.
Figure 12:
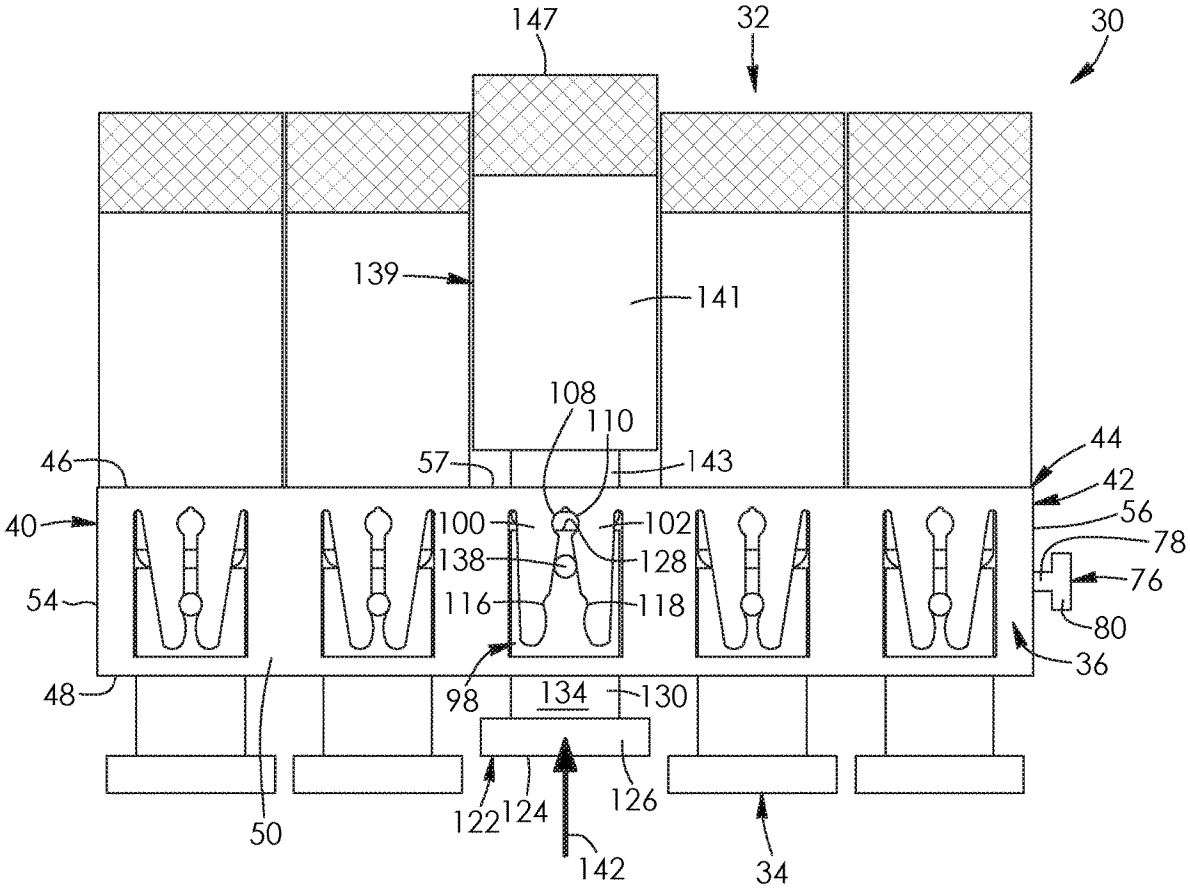
FIG. 12 is a front elevation view of the assembly of FIG. 11, with one of the actuators being shown in a partially depressed, raised position and the corresponding one of the retaining members being shown in a partially elevated position.
Figure 13:
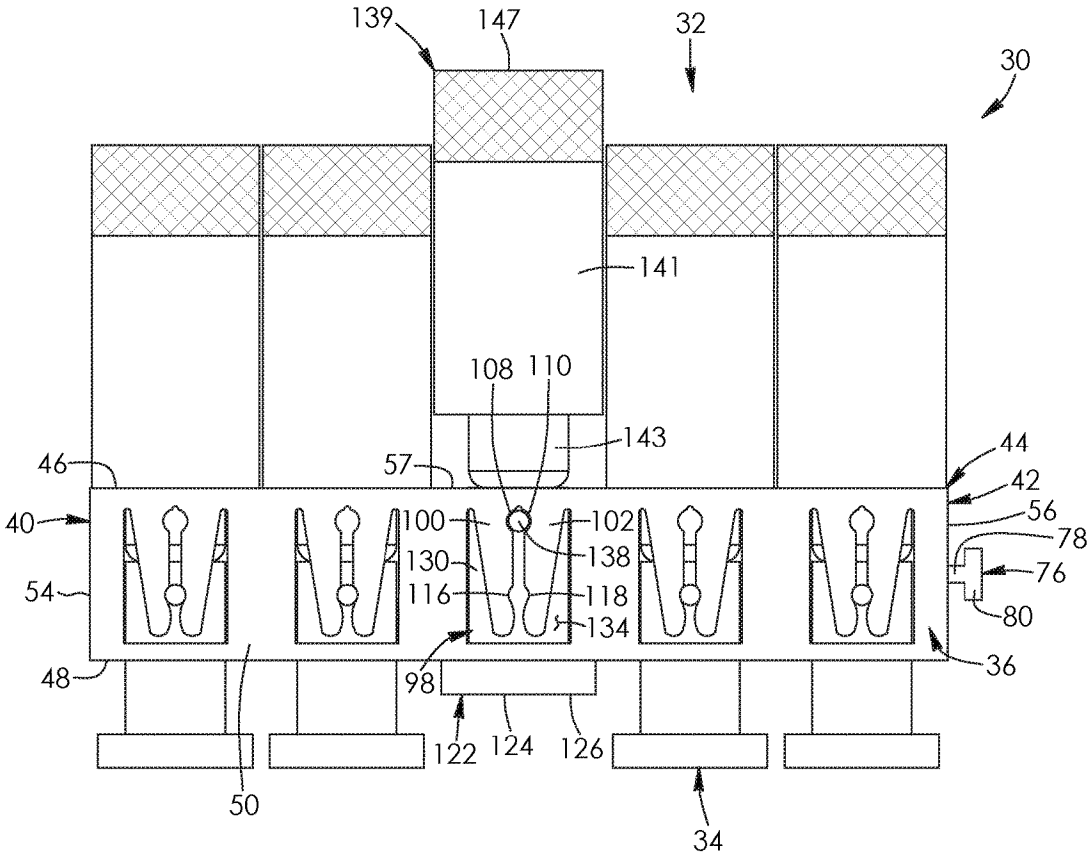
FIG. 13 is a front elevation view of the assembly of FIG. 11, with one of the actuators being shown in a fully depressed, raised position and the corresponding one of the retaining members being shown in an elevated position above the grid member of the assembly.

Each actuator 122 is moveable from an unactuated or retracted position seen in FIG. 11, to a partially actuated or depressed position seen in FIG. 12, and to a fully actuated or depressed position seen in FIG. 13. Referring back to FIG. 11, each protuberance 138 is shaped to fit within the lower recessed portions 116 and 118 of the gripping members 100 and 102 of the catch mechanism 98 when the actuator is in its retracted position. The protuberances of the corresponding actuator are thus shaped to extend between the gripping members. A pair of catch mechanisms engage with respective ones of the actuators via the protuberances of the actuator and inhibit movement of the actuators in this manner.

Figure 7:
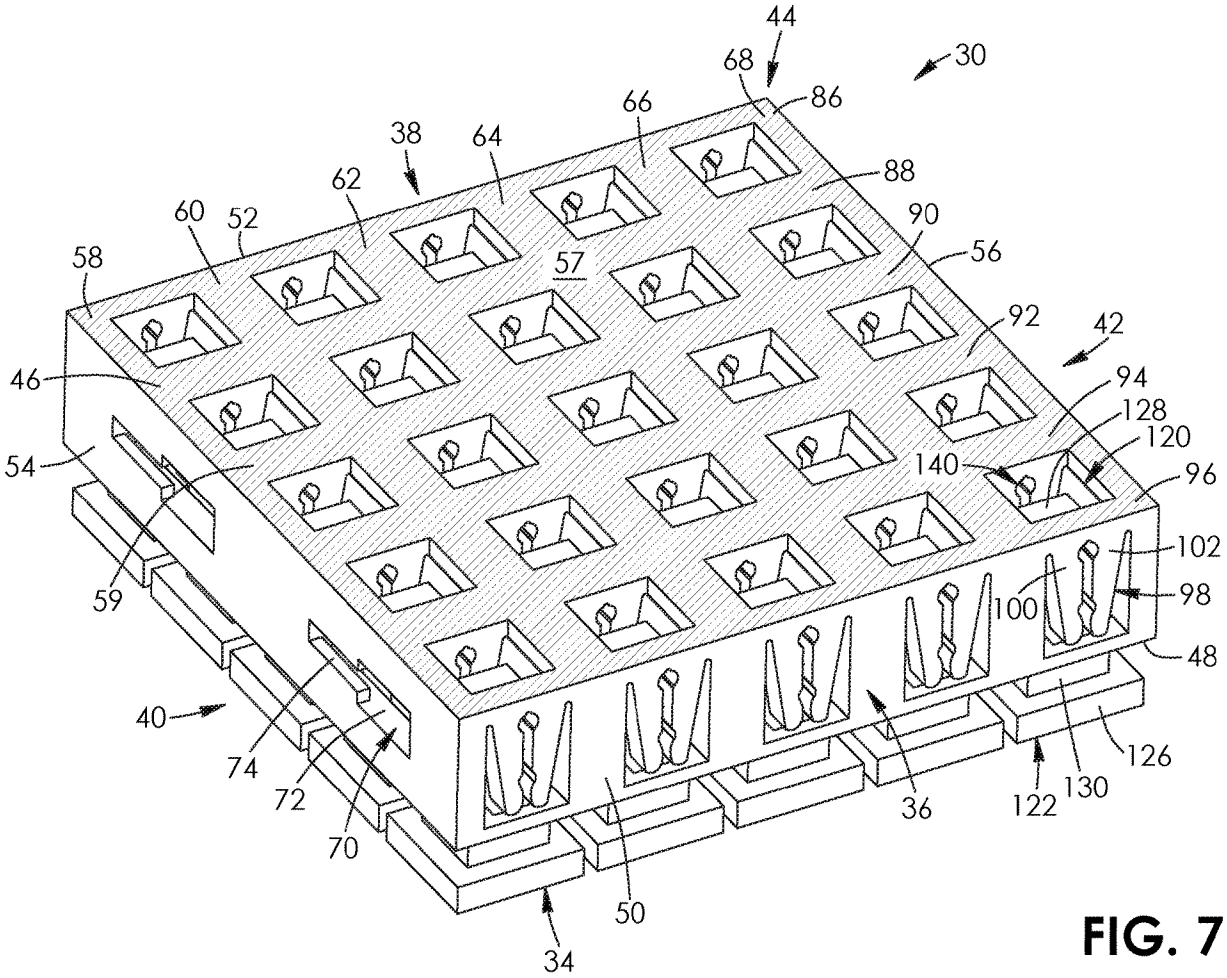
FIG. 7 is a top, front, left side isometric view of the grid member and actuators of FIG. 1, with the retaining members being removed.

As seen in FIG. 7, when the actuators 122 are inserted within the grid member 44 and in their retracted positions, a plurality of recessed portions are formed defined by respective ones of the sockets 120 of the grid member and the tops 128 of the actuators, as seen by recessed portion of numeral 140. Each of the actuators is shaped such that when the actuator is in its retracted position, at least a portion of protrusion 130 of the actuator is free of the corresponding one of the sockets 120 of the grid member 44.

As seen in FIG. 1, the assembly 30 includes a plurality of retaining members coupled to the grid member 44, as shown by retaining member 139. The retaining members are adjacent each other, are rectangular prisms in shape in this example and may be referred to as block members. The retaining members 139 are square in top profile in this example.

Figure 8:
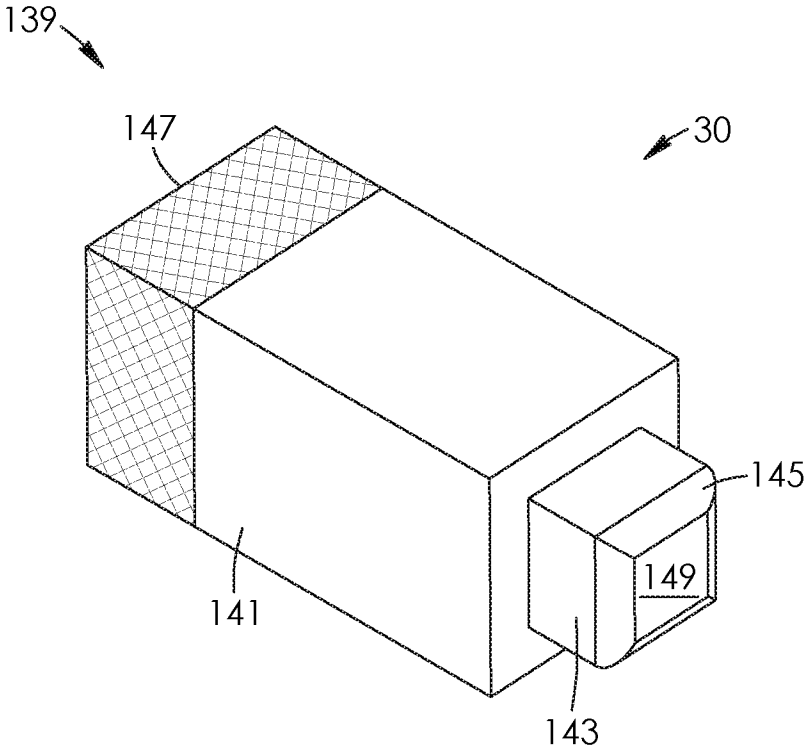
FIG. 8 is a front, side, bottom isometric view of one of the retaining members of the assembly of FIG. 1.

As seen in FIG. 1, each retaining member 139 has a top 147 and a bottom 149, seen in FIG. 8, spaced-apart from the top. The retaining members are resilient at least in part with, in this example, the tops of the retaining members being made of foam material. The tops 147 of the retaining members are rectangular prisms in shape in this example and have a second indicia thereon, in this example a second color as shown by numeral 151. The second color is different from and selected to contrast with the first color 59 of the grid member 44 seen in FIG. 3. The tops 147 of the retaining members 139 form a continuous surface when the retaining members are in the unactuated positions shown in FIG. 1.

As seen in FIG. 8, each retaining member 139 includes a first or gripping portion 141 adjacent to the top 147 and extending towards the bottom 149 thereof. Each retaining member includes a second or end portion 143 coupled to and integrally formed with the gripping portion in this case. The end portion of the retaining member 139 is adjacent with the bottom 149 of the retaining member and extends towards the top of the retaining member. End portion 143 of the retaining member is smaller than gripping portion 141 of the retaining member. The gripping portion 141 of the retaining member is a rectangular prism in shape in this example; however this is not strictly required and the gripping member may have other shapes in other embodiments. The end portion 143 of the retaining member is generally a rectangular prism in this example with a beveled end 145 in this example. The end portion 143 of the retaining member is centrally positioned relative to the gripping portion 141. The gripping portion of the retaining member 139 extends outwards relative to and is larger than the end portion of the retaining member in this example.

As seen in FIG. 9, the end portions 143 of the retaining members 139 are shaped to press-fit within respective ones of the recessed portions 140 of the grid member 44. As seen in FIG. 11, the bottom 149 of the retaining member 139 abuts the top 128 of its corresponding actuator 122 when the retaining member is inserted within the corresponding recessed portion 140 of the grid member 44 seen in FIG. 9 and when the actuator is in its retracted position.

Referring back to FIG. 11, actuation of the actuator 122, as shown by arrow of numeral 142, causes the protuberances 138 to wedge between the gripping members 100 and 102.

This causes the gripping members to deflect outwards from each other, as shown by arrows of numerals 144 and 146.

As seen in FIG. 12, such deflection enables the actuator 122, protuberances 138 and thus retaining member 139 to move upwards, from the perspective of FIG. 12. In this manner, the protuberances are dislodged from lower recessed portions 116 and 118 of the gripping members 100 and 102, and move towards the upper recessed portions 108 and 110 of the gripping members.

Figure 14:
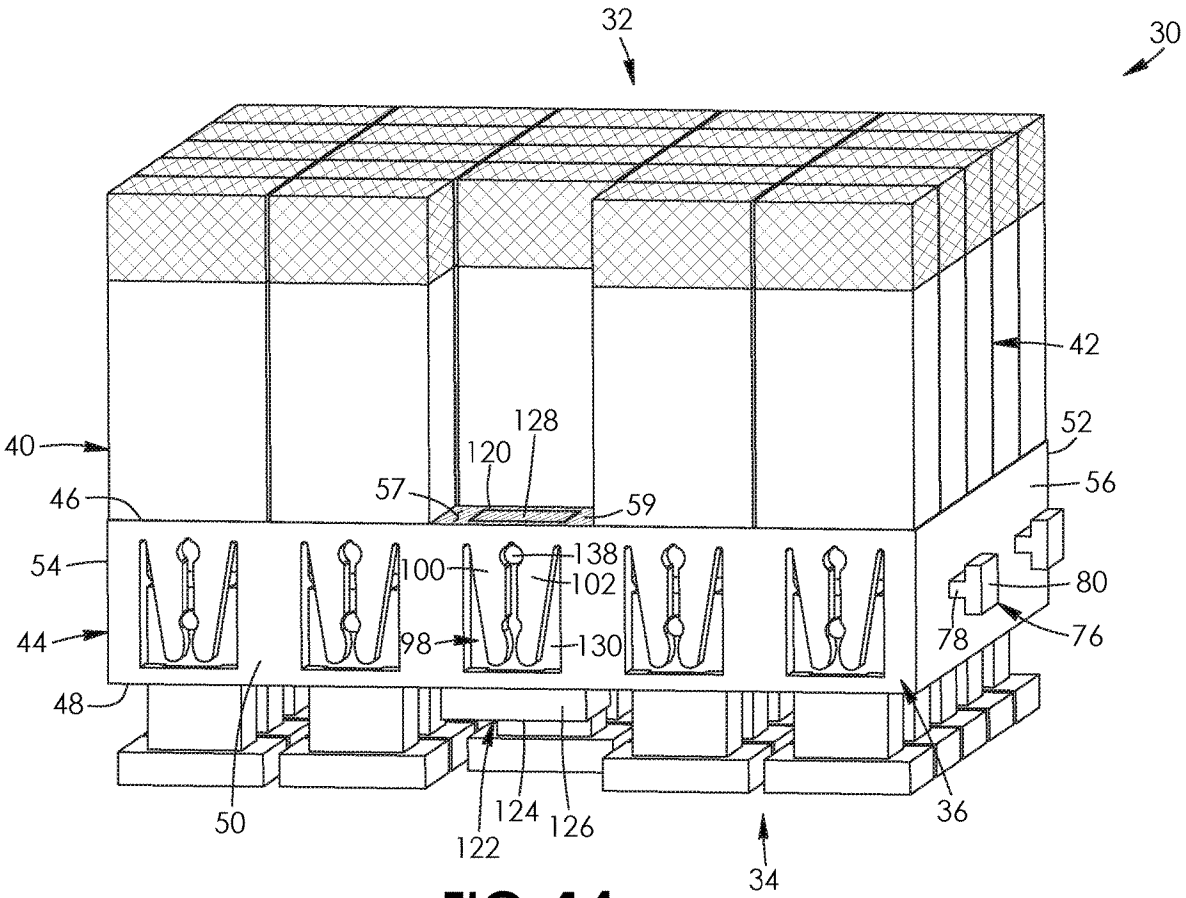
FIG. 14 is a top, front, right side isometric view of the assembly of FIG. 13, with the elevated retaining member of FIG. 13 removed.

If the actuator 122 continues to be push-actuated, as shown by arrow of numeral 148 in FIG. 12, the actuator is moveable to the fully depressed position seen in 13. The protuberances 138 of the actuator 122 are received within the upper recessed portions 108 and 110 of the gripping members 100 and 102 when the actuator is in its depressed position. The actuator in its fully depressed position releases the retaining member 139 from its press-fit connection to the grid member 44 as seen in FIG. 14. The top 128 of the actuator 122 aligns flush and in parallel with the grid member 44 when the actuator is in its fully depressed position.

Figure 15:
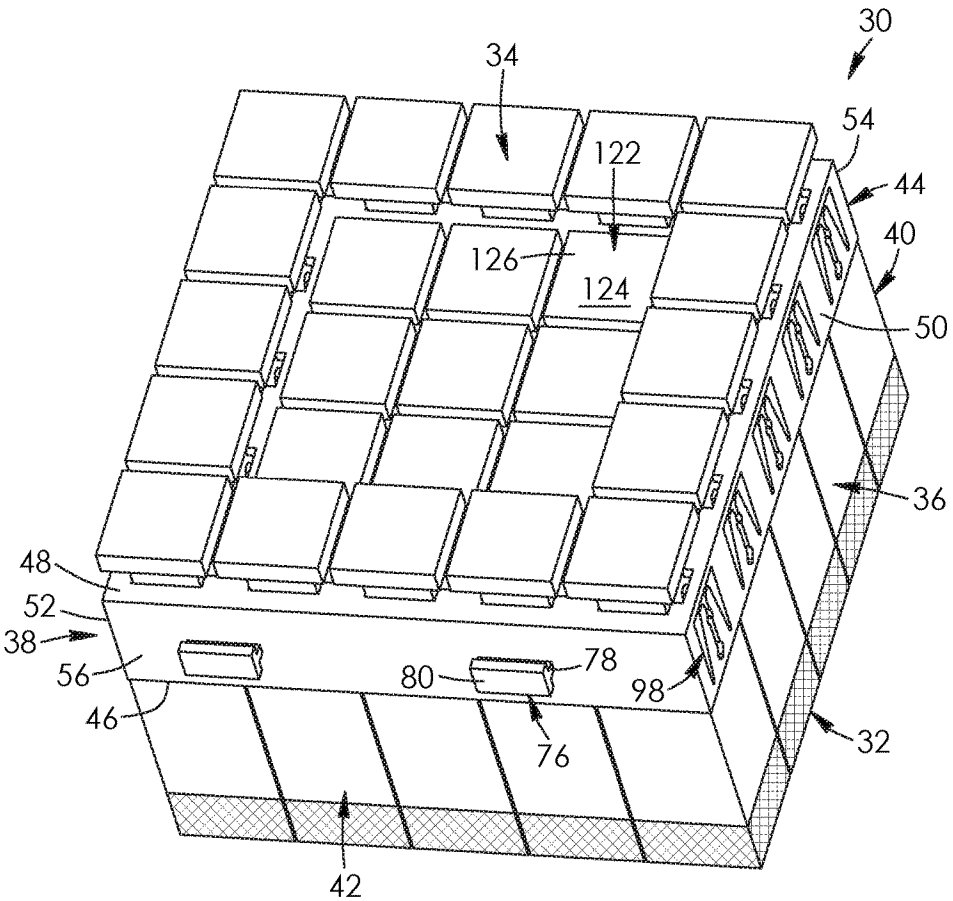
FIG. 15 is a bottom, front, right side isometric view of the tool storage assembly of FIG. 1, with inner ones of the actuators thereof shown in fully depressed positions.
Figure 16:
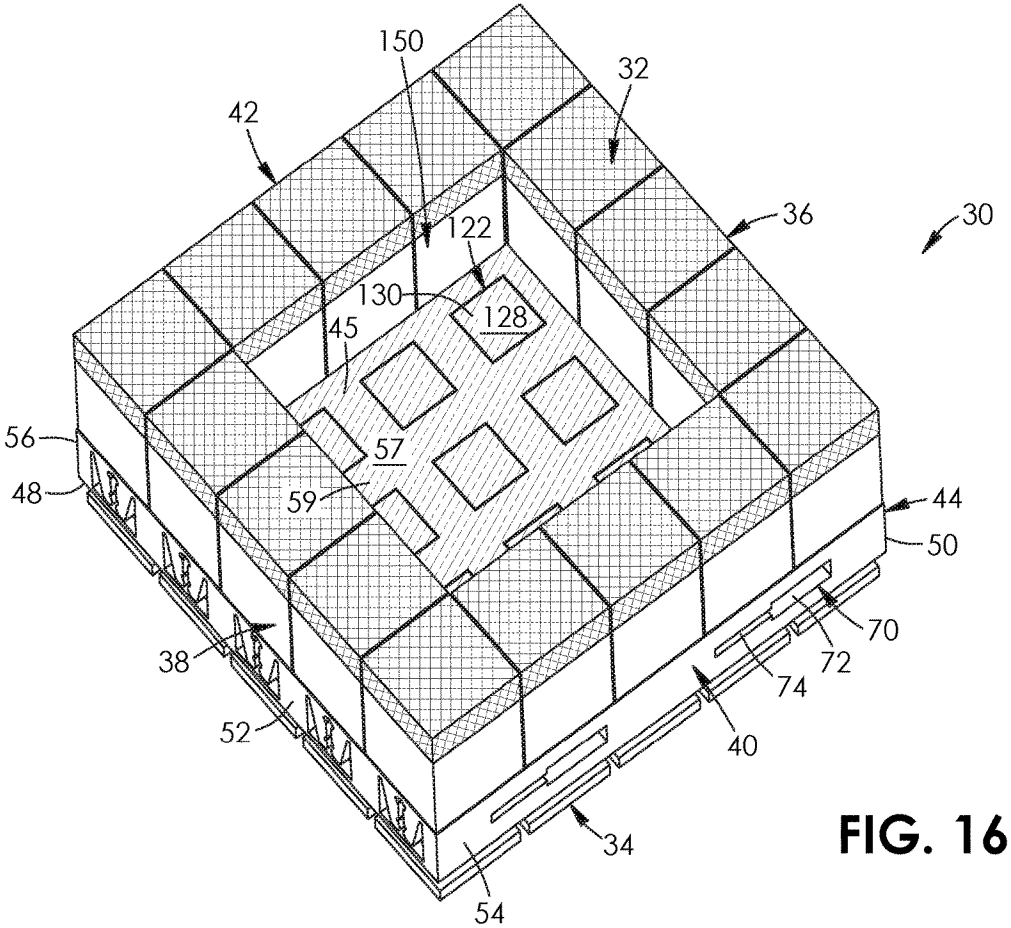
FIG. 16 is a top, rear, left side isometric view of the tool storage assembly of FIG. 15, with the inner ones of the retaining members removed.
Figure 18:
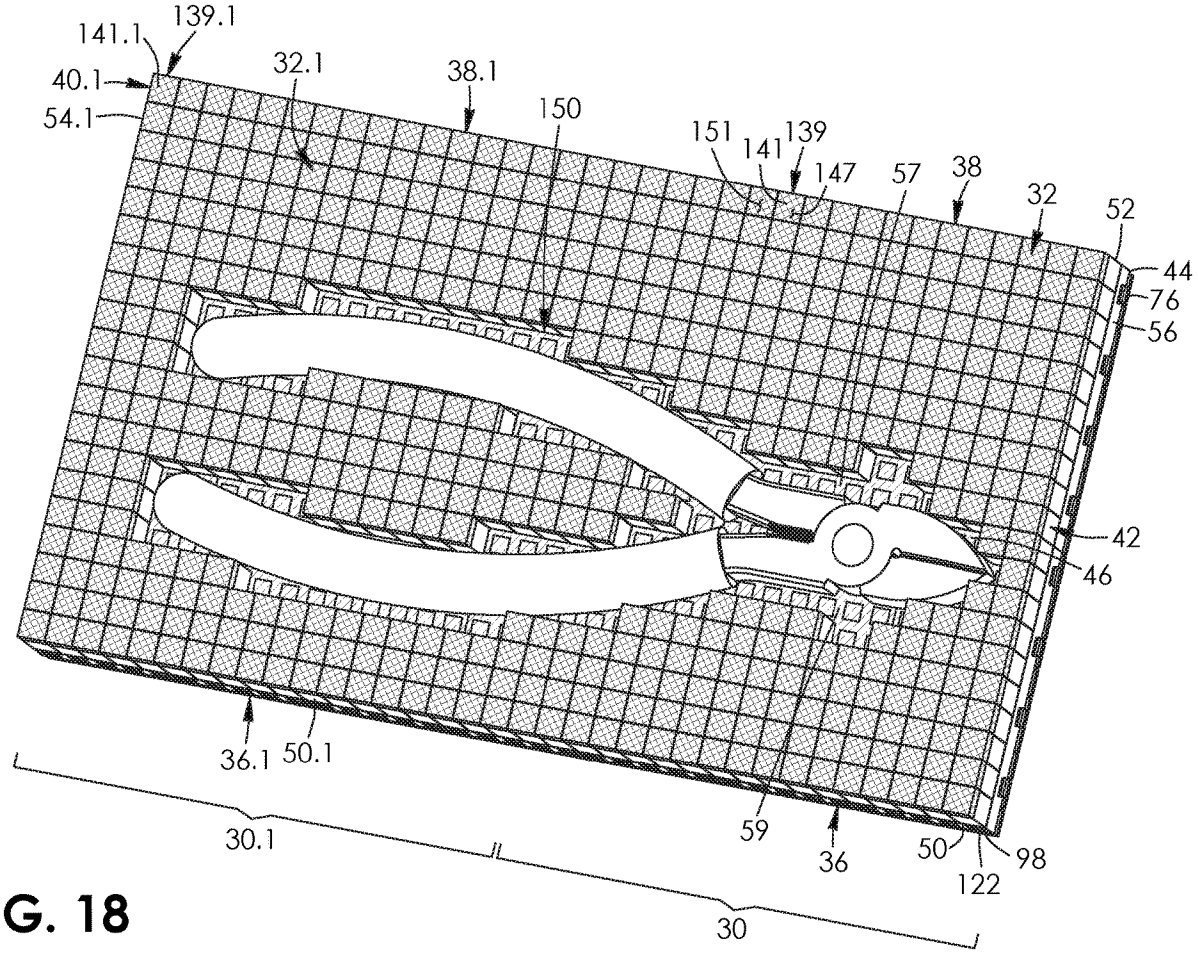
FIG. 18 is a top, front, right side perspective view of the tool storage assemblies of FIG. 17 coupled together, and a tool in the form of cutting pliers, with a custom arrangement of the actuators being shown in fully depressed positions and corresponding retaining members removed to form a receptacle for snugly receiving the pliers.

As seen in FIG. 15, this process may continue with selective actuators being actuated to remove selective retaining members. Referring to FIG. 16, remaining retaining members and the grid member 44 form a storage receptacle 150. Thus, customized actuation of selective actuators releases corresponding selective retaining members, and remaining retaining members form a plurality of customized storage receptacles thereafter, thus enclosing a customized shapes. As seen in FIG. 18, the receptacle 150 may be shaped to receive a tool, in this example cutting pliers 152 and the like therewithin.

The above set out process for removing retaining members 139 is reversible. As seen in FIG. 9, the retaining members 139 are re-connectable with the grid member 44 by pushing the end portions 143 thereof back into their corresponding recessed portions 140 of the grid member 44. The actuators 122 may return to their retracted positions.

Figure 19:
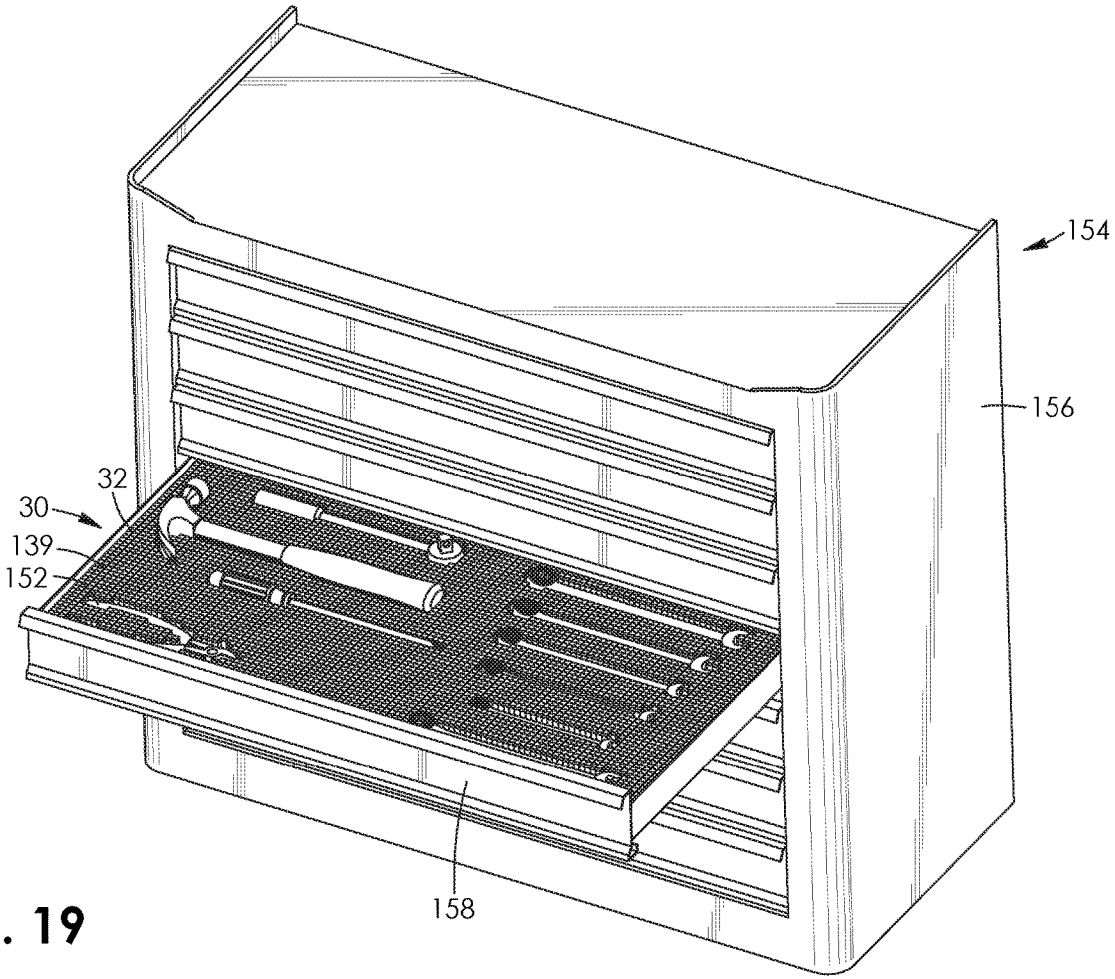
FIG. 19 is a top, front, right side perspective view of a tool drawer cabinet which includes an example of tool storage assemblies similar to FIG. 18.

FIG. 19 shows a tool drawer cabinet 154. The tool drawer cabinet includes a housing 156 to which a plurality of shelves 158 slidably couple and are selectively extendable. The tool drawer cabinet 154 includes a plurality of tool storage assemblies 30 received within respective ones of the shelves thereof.

It will be appreciated that many variations are possible within the scope of the invention described herein. It will further be understood by someone skilled in the art that many of the details provided above are by way of example only and are not intended to limit the scope of the invention which is to be determined with reference to at least the following claims.

What is claimed is:

1. A tool storage assembly comprising:

a planar base having a plurality of spaced-apart sockets extending therethrough;

a plurality of retaining members coupled to the base, the retaining members being shaped to fit at least in part within respective ones of said sockets; and at least one actuator including a protrusion shaped to fit within one of said sockets, said actuator being moveable from an unactuated position in which at least a portion of the protrusion is free of said one of the sockets, to an actuated position in which said portion of the protrusion extends within said one of the sockets and causes said at least one of said retaining members to release from the planar base of the assembly, with remaining ones of the retaining members and the planar base forming a storage receptacle thereafter.

2. The assembly as claimed in claim 1 wherein the retaining members are rectangular prisms in shape.

3. The assembly as claimed in claim 1 wherein the retaining members are resilient at least in part.

4. The assembly as claimed in claim 1 wherein the retaining members are made of foam material at least in part.

5. The assembly as claimed in claim 1 wherein the planar base has an outer surface with a first indicia thereon and wherein the retaining members have tops with a second indicia thereon, the second indicia being selected to contrast with the first indicia.

6. The assembly as claimed in claim 5 wherein the first indicia is a first color and wherein the second indicia is a second color that is different the first color.

7. The assembly as claimed in claim 1 wherein the retaining members are adjacent each other, are square in top profile, and form a continuous surface when unactuated.

8. The assembly as claimed in claim 1 wherein each of the retaining members has an end portion shaped to press-fit within a respective one of said sockets, wherein the actuator when actuated pushes said at least one of the retaining members out of its corresponding one of said sockets of the planar base, and wherein said at least one of the retaining members is re-connectable with the planar base by pushing said end portion thereof back into said corresponding one of the sockets of the planar base, the actuator returning to said unactuated position thereby.

9. The assembly as claimed in claim 1 wherein the actuator is a push-responsive actuator which has a top, the top of the actuator aligning flush and in parallel with the planar base when the actuated is actuated.

10. In combination, at least one tool and the assembly as claimed in claim 1, the receptacle being shaped to receive said tool therewithin.

11. In combination, a first said tool storage assembly as claimed in claim 1 and a second said tool storage assembly as claimed in claim 1, each of the planar bases of said assemblies being modular and being selectively connectable together at peripheral side portions thereof.

12. The combination as claimed in claim 11 wherein each of the planar bases of the assemblies has an outer surface with a first color thereon and wherein the retaining members have tops with a second color thereon, the colors being selected to contrast with each other.

13. A tool storage assembly comprising:

a planar base;

a plurality of retaining members coupled to the base;

at least one actuator including a protuberance; and at least one catch mechanism which engages with said actuator and inhibits movement thereof, the catch mechanism including a pair of cantilevered, elongate gripping members, the protuberance of the actuator being shaped to extend between said gripping members, whereby actuation of actuator causes the protuberance to wedge between said gripping members and releases at least one of said retaining members from the base, with remaining ones of the retaining members and the planar base forming a storage receptacle thereafter.

14. The assembly as claimed in claim 13, wherein the actuator is moveable from an unactuated position to an actuated position, wherein the catch mechanism has inner and outer recessed portions extending between said gripping members thereof, the inner recessed portion being adjacent to said at least one of said retaining members, the protuberance of the actuator being received within the outer recessed portion when the actuator is in said unactuated position and the protuberance of the actuator being received within the inner recessed portion when the actuator is in said actuated position.

15. The assembly as claimed in claim 13 wherein the catch mechanism is part of the planar base.

16. A block assembly comprising:

a planar base having a plurality of recessed portions;

a plurality of block members coupled to the base, each of the block members having an end portion shaped to press-fit within a respective one of said recessed portions; and a plurality of actuators each being associated with a respective ones of said block members, wherein the actuators when actuated push and release said block members out of their respective ones of the recessed portions of the planar base, with remaining ones of the block members enclosing a customized shape, and wherein the block members are re-connectable with the planar base by pushing said end portions thereof back into said corresponding one of the recessed portions of the planar base, the actuators returning to an unactuated position thereby.

17. The assembly as claimed in claim 16 wherein the block members are rectangular prisms in shape.

18. The assembly as claimed in claim 16 wherein the block members are resilient at least in part and are made of foam material at least in part.

19. The combination as claimed in claim 16, wherein selective actuation of selective ones of the actuators releases corresponding selective ones of said retaining members, and remaining ones of the retaining members form a plurality of customized storage receptacles thereafter.

20. The combination as claimed in claim 19, further including a plurality of tools, the receptacles being shaped to receive said tools therewithin.

* * * * *